US007415983B2

(12) United States Patent
Griese et al.

(10) Patent No.: US 7,415,983 B2
(45) Date of Patent: Aug. 26, 2008

(54) METHOD OF CLEANING ARTICLES IN A DISH MACHINE USING AN ACIDIC DETERGENT

(75) Inventors: Gregory G. Griese, Hudson, WI (US); Eddie D. Sowle, Woodbury, MN (US); Karen G. Peterson, Rosemount, MN (US); Christopher D. Morgan, Woodbury, MN (US)

(73) Assignee: Ecolab Inc., St. Paul, MN (US)

( * ) Notice: Subject to any disclaimer, the term of this patent is extended or adjusted under 35 U.S.C. 154(b) by 216 days.

(21) Appl. No.: 11/013,762

(22) Filed: Dec. 16, 2004

(65) Prior Publication Data

US 2005/0137107 A1 Jun. 23, 2005

Related U.S. Application Data

(63) Continuation-in-part of application No. 10/739,922, filed on Dec. 18, 2003, now abandoned.

(51) Int. Cl.
*B08B 9/20* (2006.01)

(52) U.S. Cl. ..... 134/25.2; 134/3

(58) Field of Classification Search ..... 134/25.2, 134/3

See application file for complete search history.

(56) References Cited

U.S. PATENT DOCUMENTS

| | | | | |
|---|---|---|---|---|
| 3,928,249 | A * | 12/1975 | Nunziata et al. | 510/237 |
| 4,137,190 | A | 1/1979 | Chakrabarti | |
| 4,692,260 | A * | 9/1987 | Sung et al. | 510/226 |
| 5,133,892 | A * | 7/1992 | Chun et al. | 510/224 |
| 5,704,380 | A | 1/1998 | Zelniker et al. | |
| 5,879,469 | A | 3/1999 | Avram | |
| 5,981,449 | A * | 11/1999 | Rapisarda et al. | 510/108 |
| 6,420,329 | B1 | 7/2002 | Callaghan | |
| 6,432,906 | B1 | 8/2002 | Carlson | |
| 6,551,985 | B1 * | 4/2003 | Bianchetti et al. | 510/475 |
| 6,962,898 | B2 * | 11/2005 | Kessler et al. | 510/223 |
| 2002/0065205 | A1 * | 5/2002 | Neplenbroek et al. | 510/220 |
| 2004/0194810 | A1 | 10/2004 | Strothoff | |

FOREIGN PATENT DOCUMENTS

| | | |
|---|---|---|
| DE | 19719516 | 11/1998 |
| EP | 0217732 | 4/1987 |
| EP | 0612843 | 2/1993 |
| WO | WO96/00277 | 1/1996 |
| WO | WO96/15215 | 5/1996 |
| WO | WO97/13835 | 4/1997 |
| WO | WO97/36984 | 10/1997 |
| WO | WO02/20708 | 3/2002 |
| WO | WO02/100993 | 12/2002 |

* cited by examiner

*Primary Examiner*—Lorna M Douyon
(74) *Attorney, Agent, or Firm*—Andrew D. Sorensen; Anneliese S. Mayer

(57) ABSTRACT

An acidic detergent composition can be used for removing soils on articles in a dish machine. The acidic detergent composition may be inserted into a dish machine dispenser and a use solution may be formed that contacts a soil on an article and removes the soil on the article. The composition comprises an acid and a surfactant. The composition may be a solid, liquid, gel, paste or pellet.

13 Claims, No Drawings

METHOD OF CLEANING ARTICLES IN A DISH MACHINE USING AN ACIDIC DETERGENT

CROSS REFERENCE TO RELATED APPLICATIONS

This application is a continuation-in-part of Ser. No. 10/739,922, filed on Dec. 18, 2003 now abandoned.

FIELD OF THE INVENTION

The present invention pertains to a method of cleaning articles in a dish machine using acidic detergents. In one embodiment, the invention pertains to an acidic detergent and a method of cleaning articles in a dish machine using an acidic detergent comprising an acid and a surfactant. In another embodiment, the invention pertains to an acidic detergent comprising an acid.

BACKGROUND

Historically, alkaline detergents have been used extensively to clean articles in dish machines. Alkaline detergents have been used because of their ability to remove and emulsify fatty, oily, hydrophobic soils. However, alkaline detergents have several disadvantages. For example, alkaline detergents etch glass. Mild etching has an iridescent appearance much like oil on water whereas more severe etching leaves a permanent, opaque, film-like appearance to the glass. Alkaline detergents also leave an actual film on glass. This is caused in part by using alkaline detergents in combination with certain water types, and water temperatures. While etching on glass is permanent, several solutions have been developed to solve the problems associated with the generation of hard water films. For example, rinse aids help to remove films caused by hard water. Softening the water is another way to prevent the formation of films. However, the need for rinse aids and water softeners increases the cost associated with alkaline detergents.

The co-pending PCT patent application PCT/EP02/05964 assigned to Ecolab Inc. discloses, in part, the use of acidic detergents to remove starch, where the use of an acidic detergent is followed by an alkaline detergent.

A need exists for methods and detergents that can effectively remove soils, especially hydrophobic soils, without creating the disadvantages alkaline detergents create and without the addition of extra steps like rinse aids, water softening, and two step detergent systems.

SUMMARY

Surprisingly, it has been discovered that articles in a dish machine can be cleaned using acidic detergents without having to cycle the acidic detergent with an alkaline detergent, and without the disadvantages of an alkaline detergent. Accordingly, in one embodiment, the invention pertains to a method of cleaning articles in a dish machine using an acidic detergent comprising an acid and a surfactant. The invention also pertains to a method of cleaning articles in a dish machine using an acidic detergent comprising an acid, a surfactant, and additional functional ingredients. Additionally, the invention pertains to a method of cleaning articles in a dish machine using the steps of supplying an acidic detergent composition comprising an acid and a surfactant, inserting the composition into a dispenser in a dish machine, forming a wash solution with the composition and water, contacting soil on an article in the dish machine with the wash solution, removing the soil, and rinsing the article. In another embodiment, the invention pertains to a method of cleaning articles in a dish machine using an acid. The invention also pertains to a method of cleaning articles in a dish machine using an acid and additional functional ingredients. The invention pertains to a method of cleaning articles in dish machine using the steps of supplying an acidic detergent comprising an acid, inserting the composition into a dispenser in a dish machine, forming a wash solution with the composition and water, contacting soil on an article in a dish machine with the wash solution, removing the soil, and rinsing the article.

In another embodiment, the invention pertains to a composition comprising an acid where the composition is both a dish machine detergent and a rinse additive. In another embodiment, the invention pertains to a composition comprising an acid where the composition includes an antimicrobial agent. In another embodiment, the invention pertains to a composition comprising an acid, where the composition is a dish machine detergent, a sanitizer, and a rinse additive.

These and other embodiments will be apparent to those of skill in the art and others in view of the following detailed description of some embodiments. It should be understood, however, that this summary, and the detailed description illustrate only some examples of various embodiments, and are not intended to be limiting to the invention as claimed.

DETAILED DESCRIPTION OF SOME EMBODIMENTS

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

Acidic Detergent Composition

As discussed above, the invention generally relates to a method of cleaning articles in a dish machine using acidic detergents. In one embodiment, the method involves using the steps of providing an acidic detergent composition comprising an acid and a surfactant, inserting the composition into a dispenser in a dish machine, forming a wash solution with the composition and water, contacting a soil on an article in the dish machine with the wash solution, removing the soil, and rinsing the article. In another embodiment, the method involves using the steps of providing an acidic detergent composition comprising an acid, inserting the composition into a dispenser in a dish machine, forming a wash solution with the composition and water contacting a soil on an article in the dish machine with the wash solution, removing the soil, and rinsing the article.

Traditionally, acidic detergents have not been used in dish machines in part because it was believed that they could not effectively remove soils, and hydrophobic soils in particular. However, it has been discovered that the acidic detergent composition of the present invention, when used in the method of the present invention, is effective at removing all types of soils from articles in a dish machine, including hydrophobic soils, without the negative effects of alkaline detergents such as film formation. Also, using an acidic detergent has the beneficial side effect of removing mineral deposits from the dish machine.

While not wanting to be held to any specific scientific theory, it is believed that the acidic detergents of the present invention remove soils, and hydrophobic soils in particular, because the surfactant solubilizes the soil. Nonionic alcohol ethoxylates are particularly good at removing fatty soils because the hydrocarbon group sticks into the fatty soil and the alcohol group sticks into the acid part thereby removing the fatty soil. It is also believed that the mechanical action of the dish machine helps in the cleaning because it loosens the fatty soils so that they are free in the sump but still insoluble in water. The fatty soils can then be taken up by the surfactant and made soluble.

The composition of the present invention comprises an acid and a surfactant. The composition may optionally include additional functional ingredients that enhance the effectiveness of the composition as a detergent or provide other functional aspects and features to the composition.

Acid

The composition of the present invention comprises an acid. The acid may be a single acid or a mixture of acids. The acid may be a liquid or a solid at room temperature. The acid preferably maintains an overall pH of the wash solution from 0 to 6, more preferably from 0 to 3, and most preferably from 0 to 2 as measured by a pH probe based on a solution of the composition in a 16 gallon dish machine. The acid preferably maintains an overall pH of the wash solution from about 65 to 400 mVs, from about 128 to 340 mVs, and from about 190 to 325 mVs. Additional methods of measuring the concentration of the product can be used. For example, titration can be used to measure the concentration of a product using a standard concentration of another reagent that chemically reacts with the product. This standard solution is referred to as the "titrant." Performing the titration also requires a method to determine when the reaction that occurs is complete or is brought to a certain degree of completion, which is referred to as the "end point" or more technically the equivalence point. One method that can be used is a chemical indicator which can indicate when the end point is reached. Another method to measure concentration is by using conductivity. Conductivity can be used to determine the ionic strength of a solution by measuring the ability of a solution to conduct an electric current. An instrument measures conductivity by placing two plates of conductive material with known area a known distance apart in a sample. Then a voltage potential is applied and the resulting current is measured. Finally, the concentration can be determined using the pKa and pKb of the composition.

Generally, any acid may be used in the composition of the invention. Both organic and inorganic acids have been found to be generally useful in the present composition. Organic acids useful in accordance with the invention include hydroxyacetic (glycolic) acid, citric acid, formic acid, acetic acid, propionic acid, butyric acid, valeric acid, caproic acid, gluconic acid, itaconic acid, trichloroacetic acid, urea hydrochloride, and benzoic acid, among others. Organic dicarboxylic acids such as oxalic acid, malonic acid, succinic acid, glutaric acid, maleic acid, fumaric acid, adipic acid, and terephthalic acid among others are also useful in accordance with the invention. Any combination of these organic acids may also be used intermixed or with other organic acids which allow adequate formation of the composition of the invention. Inorganic acids or mineral acids useful in accordance with the invention include phosphoric acid, sulfuric acid, sulfamic acid, methylsulfamic acid, hydrochloric acid, hydrobromic acid, hydrofluoric acid, and nitric acid among others. These acids may also be used in combination with other inorganic acids or with those organic acids mentioned above. An acid generator may also be used in the composition to form a suitable acid. For example, suitable generators include calcium phosphate, potassium fluoride, sodium fluoride, lithium fluoride, ammonium fluoride, ammonium bifluoride, sodium silicofluoride, etc. In accordance with the preferred embodiment of the present invention the acid is preferably phosphoric acid.

In one embodiment, if an organic acid is selected as the acid, the acid component of the composition may comprise up to about 99.5 wt. % (active acid) of the final detergent composition. For example, the acid preferably comprises in the range of from about 50 to about 99.5 wt. % of the total detergent composition, more preferably in the range of from about 75 to about 97 wt. % of the total detergent composition, and most preferably in the range of from about 90 to about 95 wt. % of the total detergent composition. In another embodiment, if an inorganic or mineral acid is selected as the acid, the acid component of the composition may comprise in the range from about 1 to about 85 wt. % (active acid) of the total detergent composition, more preferably in the range of from about 5 to about 75 wt. % of the total detergent composition, and most preferably in the range of from about 10 to about 75 wt. % of the total detergent composition. In another embodiment, the acid component may comprise up to 100 wt. % of the final detergent composition.

Surfactant

The surfactant or surfactant mixture of the present invention can be selected from water soluble or water dispersible nonionic, semi-polar nonionic, anionic, cationic, amphoteric, or zwitterionic surface-active agents; or any combination thereof. The particular surfactant or surfactant mixture chosen for use in the process and products of this invention can depend on the conditions of final utility, including method of manufacture, physical product form, use pH, use temperature, foam control, and soil type.

The surfactant preferably has from 6 to 30 carbon atoms, more preferably from 10 to 25 carbon atoms and most preferably from 12 to 20 carbon atoms. In accordance with the preferred embodiment of this invention, the surfactant is preferably a nonionic surfactant and a low HLB nonionic surfactant in particular. HLB, or Hydrophilic Lipophilic Balance, refers to a surfactant's solubility in water. An HLB scale was derived as a means for comparing the relative hydrophilicity of amphiphilic molecules. Molecules with an HLB value of 10 or greater indicate that the molecule is hydrophilic and soluble in water. Molecules with an HLB value less than 10 indicate that the molecule is hydrophobic and insoluble in water. The HLB system is well known to skilled surfactant chemists and is explained in the literature such as in the publication, "The HLB System," ICI Americas (1987). The preferred nonionic surfactants are alcohol ethoxylate nonionic surfactants. The preferred alcohol ethoxylate nonionic surfactants are those that are capped, for example, halogen or benzyl capped. Some non-limiting examples of commercially available alcohol ethoxylate nonionic surfactants include the following: Dehypon LS 54 available from Henkel; Tomadol 91-6, Tomadol 1-9, Tomadol 1-5, and Tomadol 1-3 available from Tomah; Plurafac D-25, and SLF-18 available from BASF; Sasol C13-9EO, Sasol C8-10-6EO, Sasol TDA C13-6EO, and Sasol C6-10-12EO available from Sasol; Hetoxol I-20-10 and Hetoxol I-20-5 available from Laurachem; Huntsman L46-7EO available from Huntmans; and Antarox BL 330 and BL 344 available from Rhodia. Antarox BL 330 and BL 344 are either branched or straight chain $C_{12}$-$C_{18}$ halogen capped alcohol ethoxylate nonionic surfactants. The benzyl capped alcohol exthoxylates are particularly useful in part because they are soluble in most acids, including phosphoric acid, despite not being soluble in water. Despite this preference, the present composition can include one or more of nonionic surfactants, anionic surfactants, cationic surfactants, the sub-class of nonionic entitled semi-polar nonionics, or those surface-active agents which are characterized by persistent cationic and anionic double ion behavior, thus differing from classical amphoteric, and which are classified as zwitterionic surfactants.

A typical listing of the classes and species of surfactants useful herein appears in U.S. Pat. No. 3,664,961 issued May 23, 1972, to Norris.

Nonionic Surfactants

Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from 1,000 to 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from 500 to 7,000; and, the hydrophile, ethylene oxide, is added to constitute from 10% by weight to 80% by weight of the molecule.

2. Condensation products of one mole of alkyl phenol wherein the alkyl chain, of straight chain or branched chain configuration, or of single or dual alkyl constituent, contains from 8 to 18 carbon atoms with from 3 to 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from 6 to 24 carbon atoms with from 3 to 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co.

4. Condensation products of one mole of saturated or unsaturated, straight or branched chain carboxylic acid having from 8 to 18 carbon atoms with from 6 to 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from 1,000 to 3,100 with the central hydrophile including 10% by weight to 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from 2,100 to 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

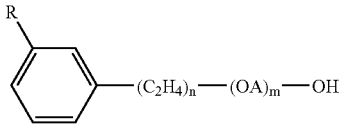

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from 1 to 6 carbon atoms and one reactive hydrogen atom, n has an average value of at least 6.4, as determined by hydroxyl number and m has a value such that the oxyethylene portion constitutes 10% to 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from 2 to 6 carbon atoms and containing x reactive hydrogen atoms in which x has a value of at least 2, n has a value such that the molecular weight of the polyoxypropylene hydrophobic base is at least 900 and m has value such that the oxyethylene content of the molecule is from 10% to 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from 8 to 18 carbon atoms and containing x reactive hydrogen atoms in which x has a value of 1 or 2, n has a value such that the molecular weight of the polyoxyethylene portion is at least 44 and m has a value such that the oxypropylene content of the molecule is from 10% to 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R^2CONR^1Z$ in which: $R^1$ is H, $C_1$-$C_4$ hydrocarbyl, 2-hydroxy ethyl, 2-hydroxy propyl, ethoxy, propoxy group, or a mixture thereof; $R^2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from 0 to 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_{10}$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from 6 to 30 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use in the present compositions include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or —$(C_2H_4O)_xH$, where x is in the range of from 1 to 3.

13. A useful class of non-ionic surfactants includes the class defined as alkoxylated amines or, most particularly, alcohol alkoxylated/aminated/alkoxylated surfactants. These non-ionic surfactants may be at least in part represented by the general formulae:

$R^{20}$—$(PO)_sN$—$(EO)_tH$, $R^{20}$—$(PO)_sN$—$(EO)_tH(EO)_tH$, and $R^{20}$—$N(EO)_tH$;

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula:

$R^{20}$—$(PO)_v$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5.

These compounds are represented commercially by a line of products sold by Huntsman Chemicals as nonionic surfactants. A preferred chemical of this class includes Surfonic™ PEA 25 Amine Alkoxylate.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

14. Amine oxides are tertiary amine oxides corresponding to the general formula:

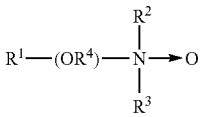

wherein the arrow is a conventional representation of a semi-polar bond; and $R^1$, $R^2$, and $R^3$ may be aliphatic, aromatic, heterocyclic, alicyclic, or combinations thereof. Generally, for amine oxides of detergent interest, $R^1$ is an alkyl radical of from 8 to 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to 20.

Useful water soluble amine oxide surfactants are selected from the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

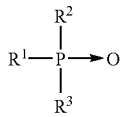

wherein the arrow is a conventional representation of a semi-polar bond; and $R^1$ is an alkyl, alkenyl or hydroxyalkyl moiety ranging from 10 to 24 carbon atoms in chain length; and $R^2$ and R are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

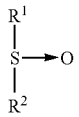

wherein the arrow is a conventional representation of a semi-polar bond; and, $R^1$ is an alkyl or hydroxyalkyl moiety of 8 to 28 carbon atoms, from 0 to 5 ether linkages and from 0 to 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

As those skilled in the art understand, anionics are excellent detersive surfactants and are therefore favored additions to heavy duty detergent compositions. Generally, however, anionics have high foam profiles which limit their use alone or at high concentration levels in cleaning systems such as CIP circuits that require strict foam control. Anionics are very useful additives to preferred compositions of the present invention. Further, anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," *Cosmetics & Toiletries*, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N-($C_1$-$C_4$ alkyl) and —N-($C_1$-$C_2$ hydroxyalkyl) glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y− and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

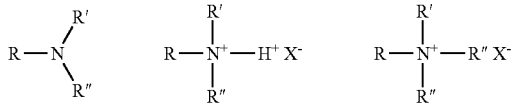

in which, R represents a long alkyl chain, R', R", and R"' may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those of skill in the art and described in "Surfactant Encyclopedia," *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

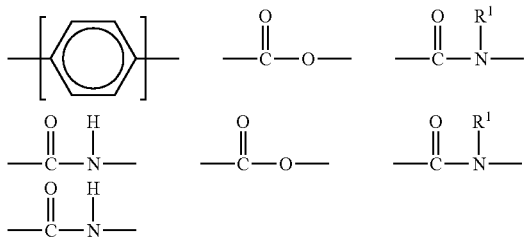

or an isomer or mixture of these structures, and which contains from 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y can be a group including, but not limited to:

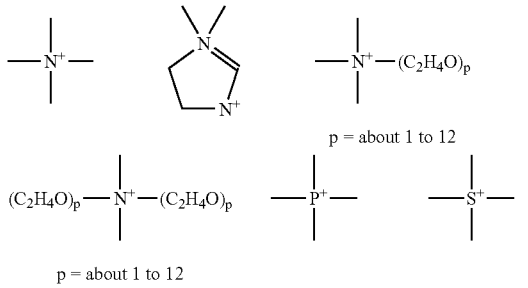

-continued

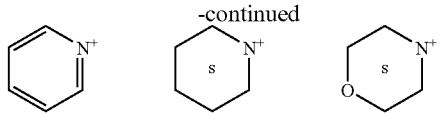

or a mixture thereof. Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as sulfate, methylsulfate, hydroxide, or nitrate anion, particularly preferred being sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," *Cosmetics & Toiletries*, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with ethyl acetate. During alkylation, one or two carboxyalkyl groups react to form a tertiary amine and an ether linkage with differing alkylating agents yielding different tertiary amines.

Long chain imidazole derivatives having application in the present invention generally have the general formula:

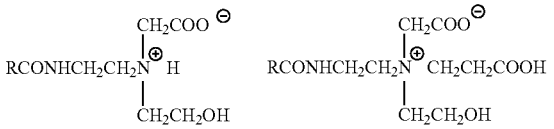

Neutral pH-Zwitterion

-continued

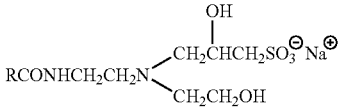

AMPHOTERIC SULFONATE wherein R is an acyclic hydrophobic group containing from 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which $R=C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof, and an aliphatic substituent of from 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol™ C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

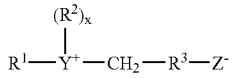

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include:

4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S [N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

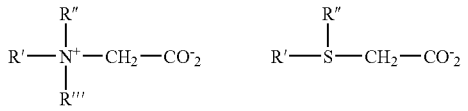

-continued

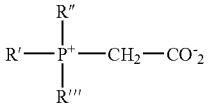

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2 N^+ R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

In one embodiment, the surfactant component of the composition may comprise up to about 50 wt. % of the final detergent composition. For example, the surfactant preferably comprises in the range of from about 2 to about 50 wt. % of the total composition, more preferably in the range of from about 1 to about 25 wt. % of the total composition, and most preferably in the range of from about 0.05 to about 5 wt. % of the total composition. In another embodiment, the surfactant may be absent from the composition.

Additional Functional Ingredients

Other active ingredients may optionally be used to improve the effectiveness of the detergent. Some non-limiting examples of such additional functional ingredients can include: anticorrosion agents, wetting agents, enzymes, foam inhibitors, antiredeposition agents, anti-etch agents, antimicrobial agents and other ingredients useful in imparting a desired characteristic or functionality in the detergent composition. The following describes some examples of such ingredients.

Anticorrosion Agents

The composition may optionally include an anticorrosion agent. Anticorrosion agents provide compositions that generate surfaces that are shiner and less prone to biofilm buildup than surfaces that are not treated with compositions having anticorrosion agents. Preferred anticorrosion agents which can be used according to the invention include phosphonates, phosphonic acids, triazoles, organic amines, sorbitan esters, carboxylic acid derivatives, sarcosinates, phosphate esters, zinc, nitrates, chromium, molybdate containing components, and borate containing components. Exemplary phosphates or phosphonic acids are available under the name Dequest (i.e., Dequest 2000, Dequest 2006, Dequest 2010, Dequest 2016, Dequest 2054, Dequest 2060, and Dequest 2066) from Solutia, Inc. of St. Louis, Mo. Exemplary triazoles are available under the name Cobratec (i.e., Cobratec 100, Cobratec TT-50-S, and Cobratec 99) from PMC Specialties Group, Inc. of Cincinnati, Ohio. Exemplary organic amines include aliphatic amines, aromatic amines, monoamines, diamines, triamines, polyamines, and their salts. Exemplary amines are available under the names Amp (i.e. Amp-95) from Angus Chemical Company of Buffalo Grove, Ill.; WGS (i.e., WGS-50) from Jacam Chemicals, LLC of Sterling, Kans.; Duomeen (i.e., Duomeen O and Duomeen C) from Akzo Nobel Chemicals, Inc. of Chicago, Ill.; DeThox amine (C Series and T Series) from DeForest Enterprises, Inc. of Boca Raton, Fla.; Deriphat series from Henkel Corp. of Ambler, Pa.; and Maxhib (AC Series) from Chemax, Inc. of Greenville, S.C. Exemplary sorbitan esters are available under the name Calgene (LA-series) from Calgene Chemical Inc. of Skokie, Ill. Exemplary carboxylic acid derivatives are available under the name Recor (i.e., Recor 12) from Ciba-Geigy Corp. of Tarrytown, N.Y. Exemplary sarcosinates are available under the names Hamposyl from Hampshire Chemical Corp. of Lexington, Mass.; and Sarkosyl from Ciba-Geigy Corp. of Tarrytown, N.Y.

The composition optionally includes an anticorrosion agent for providing enhanced luster to the metallic portions of a dish machine. When an anticorrosion agent is incorporated into the composition, it is preferably included in an amount of between about 0.05 wt. % and about 5 wt. %, between about 0.5 wt. % and about 4 wt. % and between about 1 wt. % and about 3 wt. %.

Wetting Agents

The compositions may include a wetting agent which can raise the surface activity of the composition of the invention. The wetting agent may be selected from the list of surfactants previously described. Preferred wetting agents include Triton CF 100 available from Dow Chemical, Abil 8852 available from Goldschmidt, and SLF-18-45 available from BASF. The wetting agent is preferably present from about 0.1 wt. % to about 10 wt. %, more preferably from about 0.5 wt. % to 5 wt. %, and most preferably from about 1 wt. % to about 2 wt. %.

Enzymes

The present composition may include one or more enzymes, which can provide desirable activity for removal of protein-based, carbohydrate-based, or triglyceride-based soils from substrates such as flatware, cups and bowls, and pots and pans. Enzymes suitable for the inventive composition can act by degrading or altering one or more types of soil residues encountered on a surface thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized, or otherwise more easily removed by detersive solutions containing said proteases.

Suitable enzymes include a protease, an amylase, a lipase, a gluconase, a cellulase, a peroxidase, or a mixture thereof of any suitable origin, such as vegetable, animal, bacterial, fungal or yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Preferably the enzyme is a protease, a lipase, an amylase, or a combination thereof.

A valuable reference on enzymes is "Industrial Enzymes," Scott, D., in *Kirk-Othmer Encyclopedia of Chemical Tech-*

*nology,* 3rd Edition, (editors Grayson, M. and EcKroth, D.) Vol. 9, pp. 173-224, John Wiley & Sons, New York, 1980.

Protease

A protease suitable for the present invention can be derived from a plant, an animal, or a microorganism. Preferably the protease is derived from a microorganism, such as a yeast, a mold, or a bacterium. Preferred proteases include serine proteases active at alkaline pH, preferably derived from a strain of *Bacillus* such as *Bacillus subtilis* or *Bacillus licheniformis*; these preferred proteases include native and recombinant subtilisins. The protease can be purified or a component of a microbial extract, and either wild type or variant (either chemical or recombinant). Examples of proteolytic enzymes which can be employed in the present invention include (with trade names) Savinase®; a protease derived from *Bacillus lentus* type, such as Maxacal®, Opticlean®, Durazym®, and Properase®; a protease derived from *Bacillus licheniformis*, such as Alcalase® and Maxatase®; and a protease derived from *Bacillus amyloliquefaciens*, such as Primase®. Preferred commercially available protease enzymes include those sold under the trade names Alcalase®, Savinase®, Primase®, Durazym®, or Esperase® by Novo Industries A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; and the like. A mixture of such proteases can also be used. For example, Purafect® is a preferred alkaline protease (a subtilisin) for use in detergent compositions of this invention having application in lower temperature cleaning programs, from about 30° C. to about 65° C.; whereas, Esperase® is an alkaline protease of choice for higher temperature detersive solutions, from about 50° C. to about 85° C. Suitable detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease employed in the present stabilized enzyme cleaning compositions is preferably at least 80% homologous, preferably having at least 80% sequence identity, with the amino acid sequences of the proteases in these references.

Naturally, mixtures of different proteolytic enzymes may be incorporated into this invention. While various specific enzymes have been described above, it is to be understood that any protease which can confer the desired proteolytic activity to the composition may be used and this embodiment of this invention is not limited in any way by specific choice of proteolytic enzyme. While the actual amounts of protease can be varied to provide the desired activity, the protease is preferably present from about 0.1 wt. % to about 3 wt. % more preferably from about 1 wt. % to about 3 wt. %, and most preferably about 2 wt. % of commercially available enzyme. Typical commercially available enzymes include about 5-10% of active enzyme protease.

Amylase

An amylase suitable for the stabilized enzyme cleaning composition of the present invention can be derived from a plant, an animal, or a microorganism. Preferably the amylase is derived from a microorganism, such as a yeast, a mold, or a bacterium. Preferred amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant), preferably a variant that is more stable under washing or presoak conditions than a wild type amylase.

Examples of amylase enzymes that can be employed in the stabilized enzyme cleaning composition of the invention include those sold under the trade name Rapidase by Gist-Brocades® (Netherlands); those sold under the trade names Termamyl®, Fungamyl® or Duramyl® by Novo; Purastar STL or Purastar OXAM by Genencor; and the like. Preferred commercially available amylase enzymes include the stability enhanced variant amylase sold under the trade name Duramyl® by Novo. A mixture of amylases can also be used.

Amylases suitable for the present invention include: I-amylases described in WO 95/26397, PCT/DK96/00056, and GB 1,296,839 to Novo; and stability enhanced amylases described in J. Biol. Chem., 260(11):6518-6521 (1985); WO 9510603 A, WO 9509909 A and WO 9402597 to Novo; references disclosed in WO 9402597; and WO 9418314 to Genencor International. A variant I-amylase employed in the present stabilized enzyme cleaning compositions is preferably at least 80% homologous, preferably having at least 80% sequence identity, with the amino acid sequences of the proteins of these references.

Naturally, mixtures of different amylase enzymes can be incorporated into this invention. While various specific enzymes have been described above, it is to be understood that any amylase which can confer the desired amylase activity to the composition can be used and this embodiment of this invention is not limited in any way by specific choice of amylase enzyme. While the actual amount of amylases can be varied to provide the desired activity, the amylase is preferably present from about 0.1 wt. % to about 3 wt. %, more preferably from about 1 wt. % to about 3 wt. %, and most preferably about 2 wt. % of commercially wt. % available enzyme. Typical commercially available enzymes include about 0.25 to about 5% of active amylase.

Cellulases

A cellulase suitable for the present invention can be derived from a plant, an animal, or a microorganism. Preferably the cellulase is derived from a microorganism, such as a fungus or a bacterium. Preferred cellulases include those derived from a fungus, such as *Humicola insolens, Humicola* strain DSM1800, or a cellulase 212-producing fungus belonging to the genus *Aeromonas* and those extracted from the hepatopancreas of a marine mollusk, *Dolabella Auricula* Solander. The cellulase can be purified or a component of an extract, and either wild type or variant (either chemical or recombinant).

Examples of cellulase enzymes that can be employed in the stabilized enzyme cleaning composition of the invention include those sold under the trade names Carezyme®or Celluzyme® by Novo, or Cellulase by Genencor; and the like. A mixture of cellulases can also be used. Suitable cellulases are described in patent documents including: U.S. Pat. No. 4,435,307, GB-A-2.075.028, GB-A-2.095.275, DE-OS-2.247.832, WO 9117243, and WO 9414951 A (stabilized cellulases) to Novo.

Naturally, mixtures of different cellulase enzymes can be incorporated into this invention. While various specific enzymes have been described above, it is to be understood that any cellulase which can confer the desired cellulase activity to the composition can be used and this embodiment of this invention is not limited in any way by specific choice of cellulase enzyme. While the actual amount of cellulose can be varied to provide the desired activity, the cellulose is preferably present from about 0.1 wt. % to about 3 wt. %, more preferably from about 1 wt. % to about 3 wt. %, and most preferably 2 wt. % of commercially available enzyme. Typical commercially available enzymes include about 5-10% active enzyme cellulase.

Lipases

A lipase suitable for the present invention can be derived from a plant, an animal, or a microorganism. Preferably the lipase is derived from a microorganism, such as a fungus or a bacterium. Preferred lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Examples of lipase enzymes that can be employed in the stabilized enzyme cleaning composition of the invention include those sold under the trade names Lipase P "Amano" or "Amano-P" by Amano Pharmaceutical Co. Ltd., Nagoya, Japan or under the trade name Lipolase® by Novo, and the like. Other commercially available lipases that can be employed in the present compositions include Amano-CES, lipases derived from *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa*.

A preferred lipase is sold under the trade name Lipolase® by Novo. Suitable lipases are described in patent documents including: WO 9414951 A (stabilized lipases) to Novo, WO 9205249, RD 94359044, GB 1,372,034, Japanese Patent Application 53,20487, laid open Feb. 24, 1978 to Amano Pharmaceutical Co. Ltd., and EP 341,947.

Naturally, mixtures of different lipase enzymes can be incorporated into this invention. While various specific enzymes have been described above, it is to be understood that any lipase which can confer the desired lipase activity to the composition can be used and this embodiment of this invention is not limited in any way by specific choice of lipase enzyme. While the actual amount of lipase can be varied to provide the desired activity, the lipase is preferably present from about 0.1 wt. % to about 3 wt. % more preferably from about 1 wt. % to about 3 wt. %, and most preferably about 2 wt. % of commercially available enzyme. Typical commercially available enzymes include about 5-10% active enzyme lipase.

Additional Enzymes

Additional enzymes suitable for use in the present stabilized enzyme cleaning compositions include a cutinase, a peroxidase, a gluconase, and the like. Suitable cutinase enzymes are described in WO 8809367 A to Genencor. Known peroxidases include horseradish peroxidase, lignin-ase, and haloperoxidases such as chloro- or bromo-peroxidase. Peroxidases suitable for stabilized enzyme cleaning compositions are disclosed in WO 89099813 A and WO 8909813 A to Novo. Peroxidase enzymes can be used in combination with oxygen sources, e.g., percarbonate, perborate, hydrogen peroxide, and the like. Additional enzymes suitable for incorporation into the present stabilized enzyme cleaning composition are disclosed in WO 9307263 A and WO 9307260 A to Genencor International, WO 8908694 A to Novo, and U.S. Pat. No. 3,553,139 to McCarty et al., U.S. Pat. No. 4,101,457 to Place et al., U.S. Pat. No. 4,507,219 to Hughes and U.S. Pat. No. 4,261,868 to Hora et al.

An additional enzyme, such as a cutinase or peroxidase, suitable for the stabilized enzyme cleaning composition of the present invention can be derived from a plant, an animal, or a microorganism. Preferably the enzyme is derived from a microorganism. The enzyme can be purified or a component of an extract, and either wild type or variant (either chemical or recombinant).

Naturally, mixtures of different additional enzymes can be incorporated into this invention. While various specific enzymes have been described above, it is to be understood that any additional enzyme which can confer the desired enzyme activity to the composition can be used and this embodiment of this invention is not limited in any way by specific choice of enzyme. While the actual amount of additional enzyme, such as cutinase or peroxidase, can be varied to provide the desired activity, the enzyme is preferably from about 1 wt. % to about 3 wt. %, and most preferably about 2 wt. % of commercially available enzyme. Typical commercially available enzymes include about 5-10% active enzyme.

Foam Inhibitors

A foam inhibitor may be included for reducing the stability of any foam that is formed. Examples of foam inhibitors include silicon compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, polyoxyethylene-polyoxypropylene block copolymers, alkyl phosphate esters such as monostearyl phosphate and the like. A discussion of foam inhibitors may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein. The composition preferably includes from about 0.0001 wt. % to about 5 wt. % and more preferably from about 0.01 wt. % to about 3 wt. % of the foam inhibitor.

Antiredeposition Agents

The composition may also include an antiredeposition agent capable of facilitating sustained suspension of soils in a cleaning solution and preventing the removed soils from being redeposited onto the substrate being cleaned. Examples of suitable antiredeposition agents include fatty acid amides, complex phosphate esters, styrene maleic anhydride copolymers, and cellulosic derivatives such as hydroxyethyl cellulose, hydroxypropyl cellulose, and the like. The composition preferably includes from about 0.5 wt. % to about 10 wt. % and more preferably from about 1 wt. % to about 5 wt. % of an antiredeposition agent.

Anti-Etch Agents

The composition may also include an anti-etch agent capable of preventing etching in glass. Examples of suitable anti-etch agents include adding metal ions to the composition such as zinc, zinc chloride, zinc gluconate, aluminum, and beryllium. The composition preferably includes from about 0.1 wt. % to about 10 wt. %, more preferably from about 0.5 wt. % to about 7 wt. %, and most preferably from about 1 wt. % to about 5 wt. % of an anti-etch agent.

Antimicrobial Agent

The compositions may optionally include an antimicrobial agent or preservative. Antimicrobial agents are chemical compositions that can be used in the composition to prevent microbial contamination and deterioration of commercial products material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds. The given antimicrobial agent depending on chemical composition and concentration may simply limit further proliferation of numbers of the microbe or may destroy all or a substantial proportion of the microbial population. The terms "microbes" and "microorganisms" typically refer primarily to bacteria and fungus microorganisms. In use, the antimicrobial agents are formed into the final product that when diluted and dispensed using an aqueous stream forms an aqueous disinfectant or sanitizer composition that can be contacted with a variety of surfaces resulting in prevention of growth or the killing of a substantial proportion of the microbial population. Common antimicrobial agents that may be used include phenolic antimicrobials such as pentachlorophenol, orthophenylphenol; halogen containing antibacterial agents that may be used include sodium trichloroisocyanurate, sodium dichloroisocyanurate (anhydrous or dihydrate), iodine-poly(vinylpyrolidin-onen) complexes, bromine compounds such as 2-bromo-2-nitropropane-1,3-diol; quaternary antimicrobial agents such as benzalconium chloride, cetylpyridiniumchloride; amines and nitro containing antimicrobial compositions such as hexahydro-1,3,5-tris(2-hydroxyethyl)-s-triazine, dithiocarbamates such as sodium dimethyldithiocarbamate, and a variety of other materials known in the art for their microbial properties. Antimicrobial agents may be encapsulated to improve stability and/or to reduce reactivity with other materials in the detergent composition. When an antimicrobial agent or preservative is incorporated into the composition, it is preferably included in an amount of between about 0.01 wt. % to about 5 wt. %, between about 0.01 wt. % to about 2 wt. %, and between about 0.1 wt. % to about 1.0 wt. %.

Method of Cleaning an Article in a Dish Machine

As previously discussed, in one embodiment, the method of the present invention involves using the steps of providing an acidic detergent composition comprising an acid and a surfactant, inserting the composition into a dispenser in or associated with a dish machine, forming a wash solution with the composition and water, contacting a soil on an article in the dish machine with the wash solution, removing the soil, and rinsing the article.

In another embodiment, the method of the present invention involves using the steps of providing an acidic detergent composition comprising an acid, inserting the composition into a dispenser in or associated with a dish machine, forming a wash solution with the composition and water, contacting a soil on an article in the dish machine with the wash solution, removing the soil, and rinsing the article.

In another embodiment, the invention uses a 2-in-1 composition wherein the composition is both the detergent and the rinse aid, and the method of the present invention involves using the steps of providing an acidic detergent comprising an acid, inserting the composition into a dispenser in or associated with a dish machine, forming a wash solution with the composition and water, contacting a soil on an article in the dish machine with the wash solution, removing the soil, forming a rinse solution with the composition and water, and contacting the article in the dish machine with the rinse solution.

In another embodiment, the invention uses a 3-in-1 composition, wherein the composition is the detergent, sanitizer, and rinse aid, and the method of the present invention involves using the steps of providing an acidic detergent composition comprising an acid, inserting the composition into a dispenser in or associated with a dish machine, forming a wash solution with the composition and water, contacting a soil on an article in the dish machine with the wash solution, removing the soil, forming a sanitizer solution with the composition and water, contacting the article in the dish machine with the sanitizer solution, forming a rinse solution with the composition and water, contacting the article with the rinse solution.

In another embodiment, the method of the present invention involves providing the individual components of the acidic detergent composition separately and mixing the individual components in situ with water to form a desired solution such as a wash solution, a sanitizing solution, or a rinse solution.

In another embodiment, the method of the present invention involves providing a series of cleaning compositions together in a package, wherein some of the cleaning compositions are acidic cleaning compositions, and some of the cleaning compositions are alkaline cleaning compositions. In this embodiment, a user would clean articles in a dish machine for a period of time using an acidic detergent, and after the acidic cleaning compositions were used, the user would switch to the alkaline cleaning compositions. For example, under this embodiment, three acidic cleaning compositions may be provided together with one alkaline cleaning composition. A user would wash articles in a dish machine or a period of time (i.e. three days) and then switch to the alkaline cleaning composition for a period of time (e.g. one day). This method is advantageous for removing soils on articles because it utilizes the benefits of acidic and alkaline cleaning compositions. This method is particularly advantageous if the sump of the dish machine is emptied prior to switching compositions so that the pH of the sump does not go through neutral, but remains either acidic or alkaline.

When carrying out the method of the invention, the acidic detergent composition described above is inserted into a dispenser of a dish machine. The dispenser may be selected from a variety of different dispensers depending of the physical form of the composition. For example, a liquid composition may be dispensed using a pump, either peristaltic or bellows for example, syringe/plunger injection, gravity feed, siphon feed, aspirators, unit dose, for example using a water soluble packet such as polyvinyl alcohol, or a foil pouch, evacuation from a pressurized chamber, or diffusion through a membrane or permeable surface. If the composition is a gel or a thick liquid, it may be dispensed using a pump such as a peristaltic or bellows pump, syringe/plunger injection, caulk gun, unit dose, for example using a water soluble packet such as polyvinyl alcohol or a foil pouch, evacuation from a pressurized chamber, or diffusion through a membrane or permeable surface. Finally, if the composition is a solid or powder, the composition may be dispensed using a spray, flood, auger, shaker, tablet-type dispenser, unit dose using a water soluble packet such as polyvinyl alcohol or foil pouch, or diffusion through a membrane or permeable surface. The dispenser may also be a dual dispenser in which one component, such as the acid component, is dispensed on one side and another component, such as the surfactant or antimicrobial agent, is dispensed on another side. These exemplary dispensers may be located in or associated with a variety of dish machines including under the counter dish machines, bar washers, door machines, conveyor machines, or flight machines. The dispenser may be located inside the dish machine, remote, or mounted outside of the dishwasher. A single dispenser may feed one or more dish machines.

Once the acidic detergent composition is inserted into the dispenser, the wash cycle of the dish machine is started and a wash solution is formed. The wash solution comprises the acidic detergent composition and water from the dish machine. The water may be any type of water including hard water, soft water, clean water, or dirty water. The most preferred wash solution is one that maintains the preferred pH ranges of about 0 to about 6, more preferably about 0 to about 4, and most preferably about 0 to about 3 as measured by a pH probe based on a solution of the composition in a 16 gallon dish machine. The same probe may be used to measure millivolts if the probe allows for both functions, simply by switching the probe from pH to millivolts. The dispenser or the dish machine may optionally include a pH probe to measure the pH of the wash solution throughout the wash cycle. The actual concentration or water to detergent ratio depends on the particular surfactant used. Exemplary concentration ranges may include up to 3000 ppm, preferably 1 to 3000 ppm, more preferably 100 to 3000 ppm and most preferably 300 to 2000 ppm. Again, the actual concentration used depends on the surfactant chosen.

After the wash solution is formed, the wash solution contacts a soil on an article in the dish machine. Examples of soils include soils typically encountered with food such as proteinaceous soils, hydrophobic fatty soils, starchy and sugary soils associated with carbohydrates and simple sugars, soils from milk and dairy products, fruit and vegetable soils, and the like. Soils can also include minerals, from hard water for example, such as potassium, calcium, magnesium, and sodium. Articles that may be contacted include articles made of glass, plastic, aluminum, steel, copper, brass, silver, rubber, wood, ceramic, and the like. Articles include things typically found in a dish machine such as glasses, bowls, plates, cups, pots and pans, bakeware such as cookie sheets, cake pans, muffin pans etc., silverware such as forks, spoons, knives, cooking utensils such as wooden spoons, spatulas, rubber scrapers, utility knives, tongs, grilling utensils, serving utensils, etc. The wash solution may contact the soil in a number of ways including spraying, dipping, sump-pump solution, misting and fogging.

Once the wash solution has contacted the soil, the soil is removed from the article. The removal of the soil from the article is accomplished by the chemical reaction between the wash solution and the soil as well as the mechanical action of the wash solution on the article depending on how the wash solution is contacting the article.

Once the soil is removed, the articles are rinsed as part of the dish machine wash cycle.

The method can include more steps or fewer steps than laid out here. For example, the method can include additional steps normally associated with a dish machine wash cycle. The method can also optionally include the use of an alkaline detergent. For example, the method can optionally include alternating the acidic detergent with an alkaline detergent as described. The method may include fewer steps such as not having a rinse at the end.

Method of Manufacturing the Composition

The composition of the present invention may include liquid products, thickened liquid products, gelled liquid products, paste, granular and pelletized solid compositions powders, solid block compositions, cast solid block compositions, extruded solid block composition and others. Liquid compositions can typically be made by forming the ingredients in an aqueous liquid or aqueous liquid solvent system. Such systems are typically made by dissolving or suspending the active ingredients in water or in compatible solvent and then diluting the product to an appropriate concentration, either to form a concentrate or a use solution thereof. Gelled compositions can be made similarly by dissolving or suspending the active ingredients in a compatible aqueous, aqueous liquid or mixed aqueous organic system including a gelling agent at an appropriate concentration. Solid particulate materials can be made by merely blending the dry solid ingredients in appropriate ratios or agglomerating the materials in appropriate agglomeration systems. Pelletized materials can be manufactured by compressing the solid granular or agglomerated materials in appropriate pelletizing equipment to result in appropriately sized pelletized materials. Solid block and cast solid block materials can be made by introducing into a container either a prehardened block of material or a castable liquid that hardens into a solid block within a container. Preferred containers include disposable plastic containers or water soluble film containers. Other suitable packaging for the composition includes flexible bags, packets, shrink wrap, and water soluble film such as polyvinyl alcohol.

For a more complete understanding of the invention, the following examples are given to illustrate some embodiment. These examples and experiments are to be understood as illustrative and not limiting. All parts are by weight, except where it is contrarily indicated.

EXAMPLES

Method

Glasses were tested to determine the impact on cleaning caused by the use of an alkaline detergent, the use of an acid detergent, the selection of the acid, the selection of the surfactant, and the amount of surfactant used. The alkaline detergent used was either Ecolab's SOLID POWER® detergent (sodium hydroxide, sodium carbonate, and sodium phosphate) or Ecolab's SOLID ENDURANCE PLUS detergent (sodium hydroxide, sodium carbonate, sodium phosphate, chlorine). The acidic detergent used was a combination of acid and one surfactant. A variety of surfactants and acids were tested as well as acid alone. Six to eight glasses were tested to evaluate film accumulation due to milk fat deposits in an institutional warewash machine. The glasses were prepared by first cleaning them. During the test, a concentration of 2000 ppm food soil was maintained in the wash tank throughout the test. The food soil included beef stew soils and potato soils. The dish machine was run at temperatures of 160-170° F. for the wash tank and 175-190° F. for the rinse water. The concentration of the alkaline detergent was maintained at 1000 ppm and the acidic detergent at 600 ppm. Some glasses were dipped in whole milk and allowed to dry before being washed. The other glasses remained clean. Occasionally, a streak of lipstick was added to one of the clean glasses.

For the actual test, the glasses were run for one wash cycle. Following the wash cycle, the glasses that had been dipped in whole milk were redipped and allowed to dry and then returned to the dish machine and all glasses were then sent through the wash cycle again. This was repeated until a number of cycles were run. After a number of cycles, the wash water was retested to make sure the proper level of detergent was present. Then the entire process was repeated. The glasses were then allowed to dry overnight and then visually graded for film accumulation and spotting. The film accumulation was caused by the presence of milk fat residues on the glasses and redeposition of the food soil on the glasses.

TABLE 1

Trade Names and Corresponding Description of Some Chemicals Used in the Examples

| Trademark/Chemical Name | Description | Provider |
|---|---|---|
| LF 428 | $C_{12}$-$C_{14}$, 12 mole ethoxylate, benzyl capped nonionic surfactant | Ecolab Inc. |
| LF 221 | butyl capped alcohol ethoxylate nonionic surfactant | Ecolab Inc. |
| Dehypon LS 54 | $C_{12}$-$C_{14}$, 5 mole ethoxylate, nonionic surfactant | Henkel |
| Tomadol 91-6 | $C_9$-$C_{11}$, 6 mole ethoxylate nonionic surfactant | Tomah |
| Plurafac D-25 | $C_{12}$-$C_{18}$ alcohol ethoxylate nonionic surfactant | BASF |
| SLF-18 | $C_6$-$C_{10}$ alcohol ethoxylate nonionic surfactant | BASF |
| Tomadol 1-9 | $C_{11}$, 9 mole ethoxylate, nonionic surfactant | Tomah |
| Sasol C13-9EO | $C_{13}$, 9 mole ethoxylate nonionic surfactant | Sasol |
| Sasol C8-10-6EO | $C_8$-$C_{10}$, 6 mole ethoxylate nonionic surfactant | Sasol |
| Tomadol 1-5 | $C_{11}$, 5 mole ethoxylate nonionic surfactant | Tomah |
| Hetoxol I-20-10 | $C_{20}$ alcohol ethoxylate nonionic surfactant | Laurachem |
| Hetoxol I-20-5 | $C_{20}$ alcohol ethoxylate nonionic surfactant | Laurachem |
| Aldrich Cetyl Alcohol | A long carbon chain alcohol —$C_{16}$ | Aldrich |
| Tomadol 1-3 | $C_{11}$, 3 mole ethoxylate nonionic surfactant | Tomah |
| Sasol TDA C13-6EO | $C_{13}$, 6 mole ethoxylate nonionic surfactant | Sasol |
| Huntsman L46-7EO | $C_{14}$-$C_{16}$ alcohol ethoxylate nonionic surfactant | Huntsman |
| Sasol C6-10-12EO | $C_6$-$C_{10}$, 12 mole ethoxylate nonionic surfactant | Sasol |
| BL 330 | Chloro capped alcohol ethoxyate | Rhodia |

TABLE 2

Explanation of Film and Spot Grading System

| Grade | Film | Spot |
|---|---|---|
| 1 | No film. | No spots. |
| 2 | Trace amount of film. This is a barely perceptible amount of film that is barely visible under intense spot light conditions, but is not noticeable if the glass is held up to a fluorescent light source. | Random spots. |
| 3 | A slight film is present. The glass appears slightly filmed when held up to a fluorescent light source. | ¼ of the glass is spotted. |
| 4 | A moderate amount of film is present. The glass appears hazy when held up to a fluorescent light source. | ½ of the glass is spotted. |
| 5 | A heavy amount of filming is present. The glass appears cloudy when held up to a fluorescent light source. | Whole glass is spotted. |

Example 1

Table 3 shows the results of glasses cleaned with a 1000 ppm solution of alkaline detergent (SOLID POWERS Detergent commercially available from Ecolab Inc.). The glasses that were dipped in the whole milk had a slight film on them (level 3) after the wash cycles. The glass with the lipstick had a trace amount of film (level 2) after the wash cycles and the glasses that were not pre-treated with a soil did not have any film (level 1) on them after the wash cycles.

TABLE 3

Results of Glass Testing with Alkaline Detergent

| Glass | Treatment | Film Grade |
|---|---|---|
| 1 | Dipped in Whole Milk | 3 |
| 2 | Dipped in Whole Milk | 3 |
| 3 | Dipped in Whole Milk | 3 |
| 4 | Dipped in Whole Milk | 3 |
| 5 | Dipped in Whole Milk | 3 |
| 6 | Lipstick | 2 |
| 7 | Nothing | 1 |
| 8 | Nothing | 1 |

Example 2

Example 2 tests the ability of different surfactants to remove soils. Table 4 shows the results of glasses cleaned with a 600 ppm concentration of acidic detergent comprising 95% phosphoric acid (75% grade) and 5% of various surfactants. The surfactants used were primarily nonionic surfactants and most were alcohol ethoxylates. The residue remaining on the glasses ranged from a level 1 (no film) to a level 4 (moderate film) for the glasses dipped in whole milk. Thus, some surfactants cleaned better than the alkaline detergent and some did not. The surfactants with a higher number of carbon molecules removed the residue from the glasses better than the surfactants with fewer number of carbons. For example, SLF-18, Sasol C8-10-6EO, and Sasol C6-10-12EO each have 10 carbons or less and produced a level 4 on the glasses dipped in milk fat. Tomadol 91-6 has 9-11 carbons and Sasol TDA C13-6EO has 13 carbons and both produced a level 4 on the glasses dipped in whole milk. On the other hand, Hetoxol I-20-10 and Hetoxol I-20-5 both have 20 carbons, Huntsman L46-7EO is a mixture of 14-16 carbons, and LF428 is a mixture of 12-14 carbons. These four surfactants produced a level 1 (no film) on the glasses and therefore out-performed the alkaline detergent at removing the milk fat and redeposition soils from the glasses.

TABLE 4

Results of Glass Testing with Acidic Detergent

| | Glass | | | | | | | |
|---|---|---|---|---|---|---|---|---|
| | 1 | 2 | 3 | 4 | 5 | 6 | 7 | 8 |
| Treatment | Dipped in Whole Milk | Dipped in Whole Milk | Dipped in Whole Milk | Dipped in Whole Milk | Dipped in Whole Milk | Lipstick | Nothing | Nothing |
| Surfactant @ 5% | Film Grade | Film Grade | Film Grade | Film Grade | Film Grade | Film Grade | Film Grade | Film Grade |
| LF 221 | 4 | 4 | 4 | 4 | 4 | NT* | 1 | 1 |
| Dehypon LS 54 | 2 | 2 | 2 | 2 | 2 | NT | 1 | 1 |
| Tomadol 91-6 | 4 | 4 | 4 | 4 | 4 | NT | 1 | 1 |
| Plurafac D-25 | 3 | 3 | 3 | 3 | 3 | NT | 1 | 1 |
| SLF-18 | 4 | 4 | 4 | 4 | 4 | NT | 1 | 1 |
| Tomadol 1-9 | 2 | 2 | 2 | 2 | 2 | NT | 1 | 1 |
| Sasol C13-9EO | 3 | 3 | 3 | 3 | 3 | NT | 1 | 1 |
| Sasol C8-10-6EO | 4 | 4 | 4 | 4 | 4 | NT | 1 | 1 |
| Tomadol 1-5 | 3 | 3 | 3 | 3 | 3 | NT | 1 | 1 |
| Hetoxol I-20-10 | 1 | 1 | 1 | 1 | 1 | NT | 1 | 1 |
| Hetoxol I-20-5 | 1 | 1 | 1 | 1 | 1 | NT | 1 | 1 |
| Aldrich Cetyl Alcohol | 2 | 2 | 3 | 2 | 2 | NT | 1 | 1 |
| Tomadol 1-3 | 3 | 3 | 3 | 3 | 3 | NT | 1 | 1 |
| Sasol TDA C13-6EO | 4 | 4 | 4 | 4 | 4 | NT | 1 | 1 |
| Huntsman L46-7EO | 1 | 1 | 1 | 1 | 1 | NT | 1 | 1 |
| Sasol C6-10-12-EO | 4 | 4 | 4 | 4 | 4 | NT | 1 | 1 |
| LF428 | 1 | 1 | 1 | 1 | 1 | 3 | 1 | 1 |

*NT = Not Tested

Example 3

Example 3 tested the impact of an increased amount of surfactant on the soil removal. Table 5 shows the results glasses cleaned with a 600 ppm concentration of acidic detergent comprising 75% phosphoric acid (75% grade) and 25% of either LF 221 or SLF-18. When only 5% of LF 221 and SLF-18 were used in Table 4, a moderate film (level 4) was left on the glasses dipped in whole milk in both cases. However, when 25% of LF 221 and SLF-18 were used in Table 5, no film (level 1) remained on the glasses dipped in whole milk. Therefore, Table 5 shows that an acidic detergent with 25 wt. % of surfactant is better at removing soils than an acidic detergent with 5 wt. % of surfactant. Further, the reduction in the film accumulation from a level 4 in Table 4 to a level 1 in Table 5 shows that the surfactant is contributing to the soil removal.

TABLE 5

Results of Glass Testing with Acidic Detergent

| Glass | Surfactant @ 25% Treatment | LF 221 Film Grade | SLF-18 Film Grade |
|---|---|---|---|
| 1 | Dipped in Whole Milk | 1 | 1 |
| 2 | Dipped in Whole Milk | 1 | 1 |

TABLE 5-continued

Results of Glass Testing with Acidic Detergent

| Glass | Surfactant @ 25% Treatment | LF 221 Film Grade | SLF-18 Film Grade |
|---|---|---|---|
| 3 | Dipped in Whole Milk | 1 | 1 |
| 4 | Dipped in Whole Milk | 1 | 1 |
| 5 | Dipped in Whole Milk | 1 | 1 |
| 6 | Lipstick | NT | NT |
| 7 | Nothing | 1 | 1 |
| 8 | Nothing | 1 | 1 |

Example 4

Example 4 tested the ability of various acids to removal soils and the impact of the acid selected for the detergent on the detergent's performance. In Table 6, three different acids were tested—75% phosphoric acid, 36% hydrochloric acid, and 75% urea hydrochloride. The surfactant used for each test was LF 428 (CAS #68603-21-4—a $C_{12}$-$C_{14}$, 12 mole ethoxylate, benzyl capped nonionic surfactant). The detergent was 95% of the acid and 5% of the surfactant. In every case, the amount of soil removed remained the same. The glasses that were dipped in whole milk did not have any film remaining (level 1) with each acid tested. The glasses that were not pre-treated also did not have any film remaining (level 1) with each acid tested. Table 6 shows that the amount of soil removed from the glasses is independent of the acid selected. On the other hand, tables 4 and 5 show that the amount of soil removed from the glasses is dependent on both the surfactant selected (Table 4) and the amount of surfactant used (Table 5).

TABLE 6

Results of Glass Testing with Acidic Detergent

| Glass | Surfactant @ 5% Treatment | Phosphoric Acid 75% LF 428 Film Grade | Hydrochloric Acid 36% LF 428 Film Grade | Urea Hydrochloride 75% LF 428 Film Grade |
|---|---|---|---|---|
| 1 | Dipped in Whole Milk | 1 | 1 | 1 |
| 2 | Dipped in Whole Milk | 1 | 1 | 1 |
| 3 | Dipped in Whole Milk | 1 | 1 | 1 |
| 4 | Dipped in Whole Milk | 1 | 1 | 1 |
| 5 | Dipped in Whole Milk | 1 | 1 | 1 |
| 6 | Lipstick | NT | NT | NT |
| 7 | Nothing | 1 | 1 | 1 |
| 8 | Nothing | 1 | 1 | 1 |

Example 5

Example 5 tested an acidic detergent and rinse additive combination. For this example 600 ppm of a formula having 95% phosphoric acid (75% phosphoric acid from Ashland Chemical) and 5% of BL 330 (a chloro capped alcohol ethoxylate surfactant from Rhodia) was introduced to a door dish machine via the rinse line so that the composition was used in one cycle as a rinse aid and allowed to remain in the machine to be used as the detergent in the next cycle. The glasses were evaluated after exposure to the detergent and rinse aid. For this example, six glasses were tested and the results are shown in Table 7.

TABLE 7

Results of Glass Testing Using an Acidic Composition as a Detergent and Rinse Aid

| Glass | Treatment | Film Grade | Spot Grade |
|---|---|---|---|
| 1 | Dipped in whole milk | 1.5 | 1.0 |
| 2 | Dipped in whole milk | 1.5 | 1.5 |
| 3 | Dipped in whole milk | 1.5 | 1.0 |
| 4 | Nothing | 1.5 | 1.5 |
| 5 | Nothing | 1.5 | 1.5 |
| 6 | Nothing | 1.5 | 1.5 |

The glasses that were dipped in milk or left untreated did not have any film remaining (level 1) when the acidic composition was used as a detergent and a rinse aid. The glasses also did not have any spots (level 1) when the acidic composition was used as a detergent and a rinse aid.

Example 6

Example 6 tested the impact of using an acidic composition followed by an alkaline composition in a "mixed case" wherein a user would use an acidic composition for an extended period of time and then switch to an alkaline detergent for an extended period of time. For this example, six glasses were washed using 600 ppm of an acidic composition, acting as a detergent having 95% phosphoric acid (75% phosphoric acid from Ashland Chemical) and 5% of BL 330 (a chloro capped alcohol ethoxylate surfactant from Rhodia) for 30 cycles and then the glasses were washed for 10 cycles in Solid Endurance Plus, an alkaline detergent commercially available from Ecolab Inc. Finally, the glasses were washed for another 10 cycles in the acidic composition. In between cycles the glasses that were dipped in milk were redipped. The results are described in Table 8.

TABLE 8

Results of "Mixed Case" Testing

| Glass | Treatment | Film Grade | Spot Grade |
|---|---|---|---|
| | Acidic Composition - 30 cycles | | |
| 1 | Dipped in Whole Milk | 1.5 | 2.0 |
| 2 | Dipped in Whole Milk | 1.5 | 2.0 |
| 3 | Dipped in Whole Milk | 1.5 | 2.0 |
| 4 | Nothing | 1.5 | 2.0 |
| 5 | Nothing | 1.5 | 2.0 |
| 6 | Nothing | 1.5 | 2.0 |
| | Alkaline Composition - 10 cycles | | |
| 1 | Dipped in Whole Milk | 2.0 | 3.0 |
| 2 | Dipped in Whole Milk | 2.0 | 3.0 |
| 3. | Dipped in Whole Milk | 2.0 | 3.0 |
| 4 | Nothing | 2.0 | 3.0 |
| 5 | Nothing | 1.5 | 2.5 |
| 6 | Nothing | 2.0 | 3.0 |
| | Acidic Composition - 10 cycles | | |
| 1 | Dipped in Whole Milk | 1.5 | 2.0 |
| 2 | Dipped in Whole Milk | 2.0 | 2.0 |
| 3. | Dipped in Whole Milk | 1.5 | 2.0 |
| 4 | Nothing | 1.5 | 2.0 |
| 5 | Nothing | 1.5 | 2.0 |
| 6 | Nothing | 1.5 | 2.0 |

The glasses that were dipped in whole milk and the untreated glasses had a level of 2.0 for film (no film to trace amount of film) and 2.0-3.0 for spots (spots at random to ¼ of the glass spotted).

Example 7

Example 7 tested an acidic detergent having acid alone (no surfactant). For this example a formula having 100% phosphoric acid (75% phosphoric acid from Ashland Chemical) was introduced to a door dish machine. Two tests were run, one at a pH of 5.0 and one at a pH of 3.0. The glasses were evaluated after exposure to the detergent. For this example, six glasses were tested and the results are shown in Table 9.

TABLE 9

Results of Glass Testing Using Phosphoric Acid Alone as a Detergent

| Glass | Treatment | Film Grade | Spot Grade |
|---|---|---|---|
| | pH = 5.0 | | |
| 1 | Dipped in whole milk | 2.0 | 2.0 |
| 2 | Dipped in whole milk | 2.0 | 2.0 |
| 3 | Dipped in whole milk | 2.0 | 2.5 |
| 4 | Nothing | 2.0 | 4.0 |
| 5 | Nothing | 2.0 | 4.0 |
| 6 | Nothing | 2.5 | 4.0 |

TABLE 9-continued

| Results of Glass Testing Using Phosphoric Acid Alone as a Detergent | | | |
|---|---|---|---|
| Glass | Treatment | Film Grade | Spot Grade |
| | pH = 3.0 | | |
| 1 | Dipped in whole milk | 2.0 | 4.0 |
| 2 | Dipped in whole milk | 2.0 | 4.0 |
| 3 | Dipped in whole milk | 2.0 | 4.0 |
| 4 | Nothing | 2.0 | 4.0 |
| 5 | Nothing | 2.0 | 4.0 |
| 6 | Nothing | 2.5 | 4.0 |

Table 9 shows that the acid alone was effective, but not as effective as the acid plus surfactant described in the previous examples.

Example 8

Example 8 tested hydrochloric acid as the acid in a 2-in-1 detergent and rinse aid product. For this example a formula having 47.5% hydrochloric acid (12 Normal hydrochloric acid from Monsanto), 47.5% water, and 5% BL 330 (a chloro capped alcohol ethoxylate surfactant from Rhodia) was introduced to a door dish machine via the rinse line so that the composition was used in one cycle as a rinse aid and allowed to remain in the machine to be used as the detergent in the next cycle. Enough composition was added to create a pH of 3. The glasses were evaluated after exposure to the detergent and rinse aid. For this example, six glasses were tested and the results are shown in Table 10.

TABLE 10

| Results of Glass Testing Using an Acidic Composition as a Detergent and Rinse Aid | | | |
|---|---|---|---|
| Glass | Treatment | Film Grade | Spot Grade |
| 1 | Dipped in whole milk | 1.5 | 1.0 |
| 2 | Dipped in whole milk | 1.5 | 1.5 |
| 3 | Dipped in whole milk | 1.5 | 1.5 |
| 4 | Nothing | 1.5 | 1.5 |
| 5 | Nothing | 1.5 | 1.5 |
| 6 | Nothing | 1.5 | 1.5 |

The glasses that were dipped in milk or left untreated did not have any film remaining or had only a trace amount of film (level 1.5) when the acidic composition was used as a detergent and a rinse aid. The glasses also did not have any spots to some spots at random (level 1.5) when the acidic composition was used as a detergent and a rinse aid. The results are comparable to those achieved using phosphoric acid and surfactant (Table 7).

The foregoing summary, detailed description, and examples provide a sound basis for understanding the invention, and some specific example embodiments of the invention. Since the invention can comprise a variety of embodiments, the above information is not intended to be limiting. The invention resides in the claims.

What is claimed is:

1. A method of cleaning glassware in a dish machine comprising:

a. providing an acidic cleaning composition comprising:

i. a mineral acid; and ii. a surfactant, wherein the mineral acid is present at about 36-95 wt.-% of the total weight, and the surfactant is present at about 2 to 50 wt.-% of the total weight of the acidic cleaning composition;

b. inserting the acidic cleaning composition into a dispenser of the dish machine;

c. forming a wash solution wherein the wash solution is a mixture of the acidic cleaning composition and water and the wash solution has a pH in the range of about 0-3;

d. contacting a soil on the glassware with the wash solution;

e. removing the soil on the glassware;

f. forming a rinse solution with the acidic cleaning composition and water; and g. contacting the glassware with the rinse solution.

2. The method of claim 1, wherein the surfactant is a nonionic surfactant.

3. The method of claim 2, wherein the nonionic surfactant is an alcohol ethoxylate.

4. The method of claim 1, wherein the acidic cleaning composition further comprises an additional functional ingredient.

5. The method of claim 4, wherein the additional functional ingredient is selected from the group consisting of anticorrosion agents, wetting agents, enzymes, foam inhibitors, antiredeposition agents, anti-etch agents, and mixtures thereof.

6. The method of claim 1, wherein the mineral acid is hydrochloric acid.

7. The method of claim 1, wherein the composition is a solid.

8. The method of claim 1, wherein the composition is a liquid.

9. The method of claim 1, wherein the composition is a gel.

10. The method of claim 1, wherein the composition is a pellet.

11. The method of claim 1, wherein the soil is selected from the group consisting of a starch, a protein, a fat, and mixtures thereof.

12. The method of claim 1, wherein the surfactant has at least ten carbon atoms.

13. A method of cleaning glassware in a dish machine comprising:

a. providing an acidic cleaning composition comprising:

i. an acid selected from the group consisting of phosphoric acid, hydrochloric acid, and mixture thereof; and ii. a nonionic surfactant having at least 10 carbon atoms, wherein the acid present at about 36% to 95 wt % of the total weight of the acidic cleaning composition;

b. inserting the acidic cleaning composition into a dispenser of the dish machine;

c. forming a wash solution wherein the wash solution is a mixture of the acidic cleaning composition and water, wherein the pH of the wash solution is in the range of from 0 to 3;

d. contacting a soil on the glassware with the wash solution;

e. removing the soil on the glassware;

f. forming a rinse solution with the acidic cleaning composition and water; and g. contacting the glassware with the rinse solution.

* * * * *